US006068357A

United States Patent [19]

Keller et al.

[11] Patent Number: 6,068,357

[45] **Date of Patent: *May 30, 2000**

[54] HIDDEN PHOTOGRAPH STORAGE MEANS

[76] Inventors: William Keller, 10194 Dover Carriage La., Lake Worth, Fla. 33467; Charles Bergeron, 107 NE. 17th Ave., Fort Lauderdale, Fla. 33301

[ * ] Notice: This patent is subject to a terminal disclaimer.

[21] Appl. No.: 08/771,018

[22] Filed: Dec. 20, 1996

Related U.S. Application Data

[63] Continuation-in-part of application No. 08/554,762, Nov. 7, 1995, Pat. No. 5,690,404.

[51] Int. Cl.[7] ..... A47B 88/00

[52] U.S. Cl. ..... 312/310; 312/322; 312/183; 312/242; 312/245; 40/388; 40/394

[58] Field of Search ..... 312/242, 245, 312/183, 322, 310, 350; 40/388, 394, 405, 492

[56] References Cited

U.S. PATENT DOCUMENTS

| | | | |
|---|---|---|---|
| 752,463 | 2/1904 | Morris | 40/388 X |
| 1,327,848 | 1/1920 | Woodhouse | 40/394 |
| 1,509,285 | 9/1924 | Colbow, Jr. | 312/242 X |
| 1,698,586 | 1/1929 | Garfield | 40/394 |
| 1,854,807 | 4/1932 | Powell | 40/388 |
| 1,916,209 | 7/1933 | Furlong | 40/388 |
| 1,923,366 | 8/1933 | Garfield | 40/394 |
| 1,935,641 | 11/1933 | Kline | 40/388 X |
| 1,948,738 | 2/1934 | Thayer | 312/245 X |
| 2,086,472 | 7/1937 | Clark | 40/388 X |
| 2,649,799 | 8/1953 | Sportus . | |
| 2,936,680 | 5/1960 | Copen | 40/405 X |
| 3,079,771 | 3/1963 | Donle . | |
| 3,286,382 | 11/1966 | Newman | 312/183 |
| 3,514,883 | 6/1970 | Albright | 40/492 |
| 3,589,049 | 6/1971 | Cornelius . | |
| 4,304,447 | 12/1981 | Ellwood et al. . | |
| 4,400,899 | 8/1983 | Martinez | 40/394 X |
| 4,413,736 | 11/1983 | Nibling . | |
| 4,794,713 | 1/1989 | Yang | 40/388 X |
| 5,215,364 | 6/1993 | Moore | 40/394 X |
| 5,247,744 | 9/1993 | Ferris et al. . | |
| 5,368,378 | 11/1994 | Curtis | 312/242 X |
| 5,421,665 | 6/1995 | Strassberg | 40/405 X |
| 5,690,404 | 11/1997 | Keller | 312/310 |

FOREIGN PATENT DOCUMENTS

| | | | |
|---|---|---|---|
| 1054666 | 5/1979 | Canada | 312/242 |

*Primary Examiner*—Peter M. Cuomo
*Assistant Examiner*—Rodney B. White
*Attorney, Agent, or Firm*—Malin, Haley & DiMaggio, P.A.

[57] ABSTRACT

A hidden photograph storage and display device including an open front boxlike formation providing for display of a very large number of photographs mounted on multiple photographic panel or sheets. A cover is hingedly mounted on the boxlike formation for closing off the front of the boxlike formation and concealing the hundreds of photographs mounted on the photographic panels or sheets. The photographic panels are mounted in a unique parallel manner to provide for storage of such a large number of photographs. When the cover is closed, the device appears to be a picture, photograph, wall unit, cabinet, or other surface.

19 Claims, 3 Drawing Sheets

32
22
42c
42d
42e
42b
42a
54
56
30

10
46a
52
40
48a
14
24
26

42a
44a
50
58
20
18
12
482
28
462
1630
442

HIDDEN PHOTOGRAPH STORAGE MEANS

This Application is a continuation-in-part of U.S. patent application Ser. No. 08/554,762, filed Nov. 7, 1995, now U.S. Pat. No. 5,690,404.

BACKGROUND OF THE INVENTION

1. Field of the Invention

This invention relates generally to a hidden photographic storage device, and more particularly, to a photographic storage device hidden behind a conventional painting or within a conventional wall unit.

2. Description of Related Art

The ready accessibility of a plurality of photographs, while at the same time hiding such photographs, is a problem known in the art. Photographs of the family taken over the years are priceless visual memories of rare moments and occasions in the ensuing lifer of a family. Unfortunately, after the photographs are initially developed and viewed, they are usually either placed in a photograph album and rarely viewed or they are placed loose in a bag and also rarely viewed. The album or bag is typically placed in a drawer somewhere amongst other items, thus, depriving the family of the joy of reliving special moments and priceless visual memories of its evolution through photographs of the events.

For example, a parent or grandparent can find much joy in viewing pictures of his or her child or grandchild in their younger years while currently talking to such child or grandchild on the phone. Normally, such pictures or photographs are not readily accessible but are stored in photograph albums stored in a drawer somewhere in the house.

If an individual wished to view such pictures or photographs, the individual must put the caller on hold and go to the drawer to retrieve the photograph album containing the desired pictures. Furthermore, the desired pictures may be located in several different albums or located in one of several different photographic albums, thus, requiring the individual to expend time to locate the correct photographic album. As precious time is wasted in addition to leaving the caller on hold, normally the parent or grandparent would not undertake such tasks, Thus, the individual is deprived of the joy and pleasure of quickly reviewing the development of the caller.

Additionally, if the parent or grandparent does pull the correct photographic albums for review, such individual is then required to return the albums to the proper albums, thus resulting in additional time lost.

The above example is just one of a limitless number of examples which shows the travesty of not having the family photographs ever present and easily accessible at all times, despite the fact that it could offer so much joy at a moments notice.

U.S. Pat. No. 3,589,049, issued to Cornelius, discloses a picture frame box having a record holder. The device includes an open front box formation, a looseleaf ring binder having a backbone, means for mounting the ring binder in the box formation and a cover hingedly mounted on the box formation for closing off the front of the box formation and concealing record sheets mounted on the ring binder. The device is used for record storage. However, the ring binders are limited as to the volume of storage available, as the number of sheets that can be stored in a ring binder is directly proportional to the thickness of each sheet and the size of the binder. The thicker the sheet, the fewer sheets can be used on a given size binder.

Accordingly, the Cornelius device is impractical with respect to storing a plurality of photographs, which require each sheet to be relatively thick. Photographs can be stored in many multiples or layers per sheet resulting in fairly thick sheets. To use a ring binder for storage of sheets of multiple photographs would either limit the number of photographs storable per sheet, limit the number of sheets that could be stored on the binder, or require the use of very large binder rings, causing the picture not to look normally, and alerting a person to the fact that something is hidden behind the picture.

U.S. Pat. No. 4,226,037 issued to Rodriguez, discloses a wall display device for an office which nests together three separate display pieces and gives the appearance of a framed picture when not in use. An angled hinge permits a slimline appearance and permits the device to be essentially flush with the wall. The construction of the wall device presents a decorative appearance and provides for a variety of functional and illustrative display surfaces and/or a visual display device located in the center section adjacent to the wall. The display device has five surfaces available for display with up to three surfaces visible at once.

The hinged closure method of the Rodriguez device provides a relatively thin wall mounted display and has a shallow depth which is substantially flush with the wall both in the open and closed positions. The thin requirement does not permit the display of a large multiplicity of photographs as the individual display surfaces would become too thick to function properly.

Other devices include U.S. Pat. Nos. 5,247,744, 4,936,038, 4,413,736, and 4,304,447. However, none of these devices are intended for hidden storage of photographs nor solve the problems of the prior art discussed above.

Lastly, U.S. Pat. No. 2,649,799 issued to M. Spertus discloses a picture frame album, display photographs, essentially one at a time, primarily from an inclined, easel supported frame that rests on a surface. The device has a front picture frame concealing a hidden photo album. Each sheet in the hidden photo album compartment is designed to hold a single photograph and permits viewing of a plurality of photographs in essentially a sequential manner.

Thus, what is needed in the are is a readily accessible photograph album, which allows a plurality of photographs to be stored in their normal way, i.e. layered, and is hidden when the pictures or photographs are not being viewed. It is therefore, to the effective resolution of the aforementioned problems and shortcomings of the prior art that the present invention is directed.

SUMMARY OF THE INVENTION

The present invention generally discloses a hidden photographic storage device having the capability to display a plurality of panels or sheets each containing a multiplicity of photographs, and store such photographs in a hidden but easily accessible manner. In a first embodiment, the device has a hinged cover which has the external appearance of a conventional picture, photograph, painting, or other artwork which is normally hung on a wall area. In a second embodiment the hidden photographic storage device is disposed within a cabinet area of a wall unit or other similar piece of furniture, and is hidden when the cabinet door is closed.

With the first embodiment of the present invention, the cover, which houses the conspicuous painting, picture, photograph, collage, mirror, etc., is hingedly attached to a boxlike formation which serves as a storage area for the photographic sheets. The size of the boxlike formation is not limited to any specific dimensions, however, it is preferable that the formation being relatively large to allow a vast amount of the photographs to be stored within a single area. The present invention is also not limited in the amount of photographic panels or sheets which can be utilized, and merely for example purposes, the present invention is shown consisting of six photographic panels. Each of the photographic panels or sheets, is preferably, able to store a plurality of photographs on each side of the panel, and may also have attached to the face of the sheets conventional layers of photograph insert sleeves.

Furthermore, the shape of the storage area is not limited to a boxlike formation, and other shapes can be utilized and are considered within the scope of the invention. Each panel is preferably constructed from wood, though other materials may be utilized and are considered within the scope of the invention. Each panel is preferably provided with a certain amount of thickness to insure that each panel is rigid, and not relatively flimsy.

The painting, mirror, etc. in the cover, can be disposed away from the wall to create a three dimensional effect. Thus, the painting or mirror can look embossed and beautifully accentuated as compared to being flush mounted to the wall.

With the second embodiment of the invention, the size and amount of photographic panels or sheets is limited by the size of the cabinet or space in the wall unit or other piece of furniture. The additional depth in the cabinet may still be utilized for conventional purposes such as storage space for miscellaneous personal items, i.e. photographic equipment, excess pictures, negative storage, etc. The storage device can be hidden by den or cabinet doors associated with the wall unit or other piece of furniture.

In either embodiment, the present invention has a unique attachment method for the photographic panels that does not restrict thickness of each panel, allowing the panel to be rigid and also allowing for a plurality of photographs to be stored to each panel without the sheet collapsing or otherwise failing. Whereas a ring binder attempts to store all of its panels in the same plane, in this invention, the photographic panels are attached such that each panel lies in a plane parallel to the plane of any other panel in the device. Because each panel lies in a separate parallel plane, the permitted thickness of each panel is only dependent upon the spacing of the parallel planes, which is a selectable variable. Without a strict limitation on thickness, a multiplicity of photographs can be attached to each panel, thereby providing storage and display of hundreds upon hundreds of photographs.

The present invention provides an easily accessible and unobtrusive device for the storage of a very large amount of photographs which help to create a priceless visual calendar of the life and growth of a family and/or the family's friends and acquaintances.

Accordingly, it is an objective of the present invention to provide for hidden storage of a multiplicity of photographs while appearing to be a single hung photograph, single hung picture, single hung artwork, cabinet door in a wall unit or other piece of furniture, or similar surface.

It is a further objective of the invention to display a plurality of panels each containing a multiplicity of photographs by simple opening of a hinged cover.

It is still a further objective of the invention to provide for hidden storage space behind the stored photographic sheets.

It is another objective of the present invention to provide for hidden photographic storage device wherein a vast amount of photographs are easily stored, organized and readily accessible.

In accordance with these and other objects which will become apparent hereinafter, the instant invention will now be described with particular reference to the accompanying drawings.

DESCRIPTION OF THE PREFERRED EMBODIMENTS

Figures 1, 2:
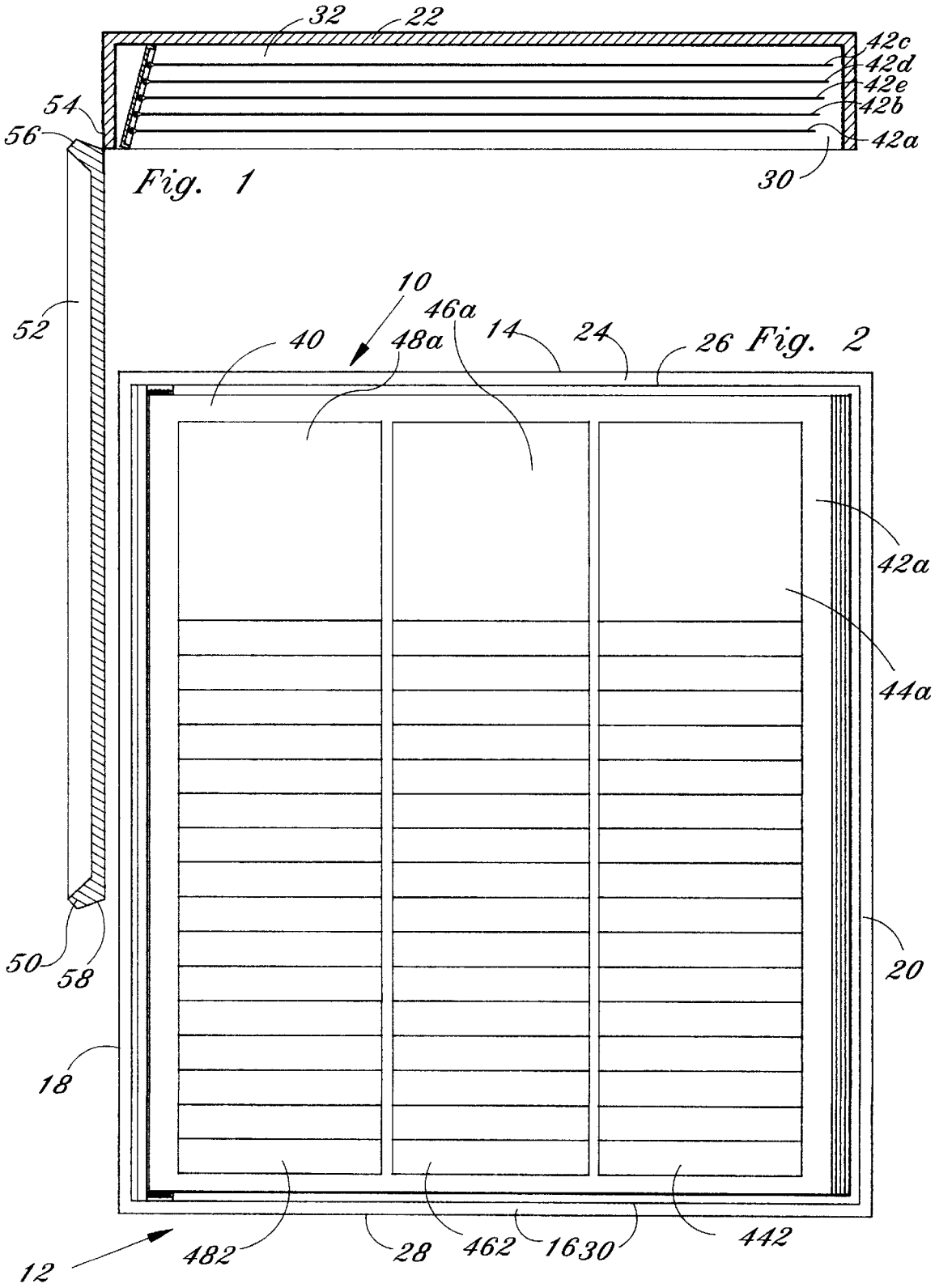
FIG. 1 is a top view of a first embodiment of the present invention with its cover member in an open position and a top member removed.
FIG. 2 is a front elevational view of the first embodiment of the present invention with its cover member removed.
Figure 3:
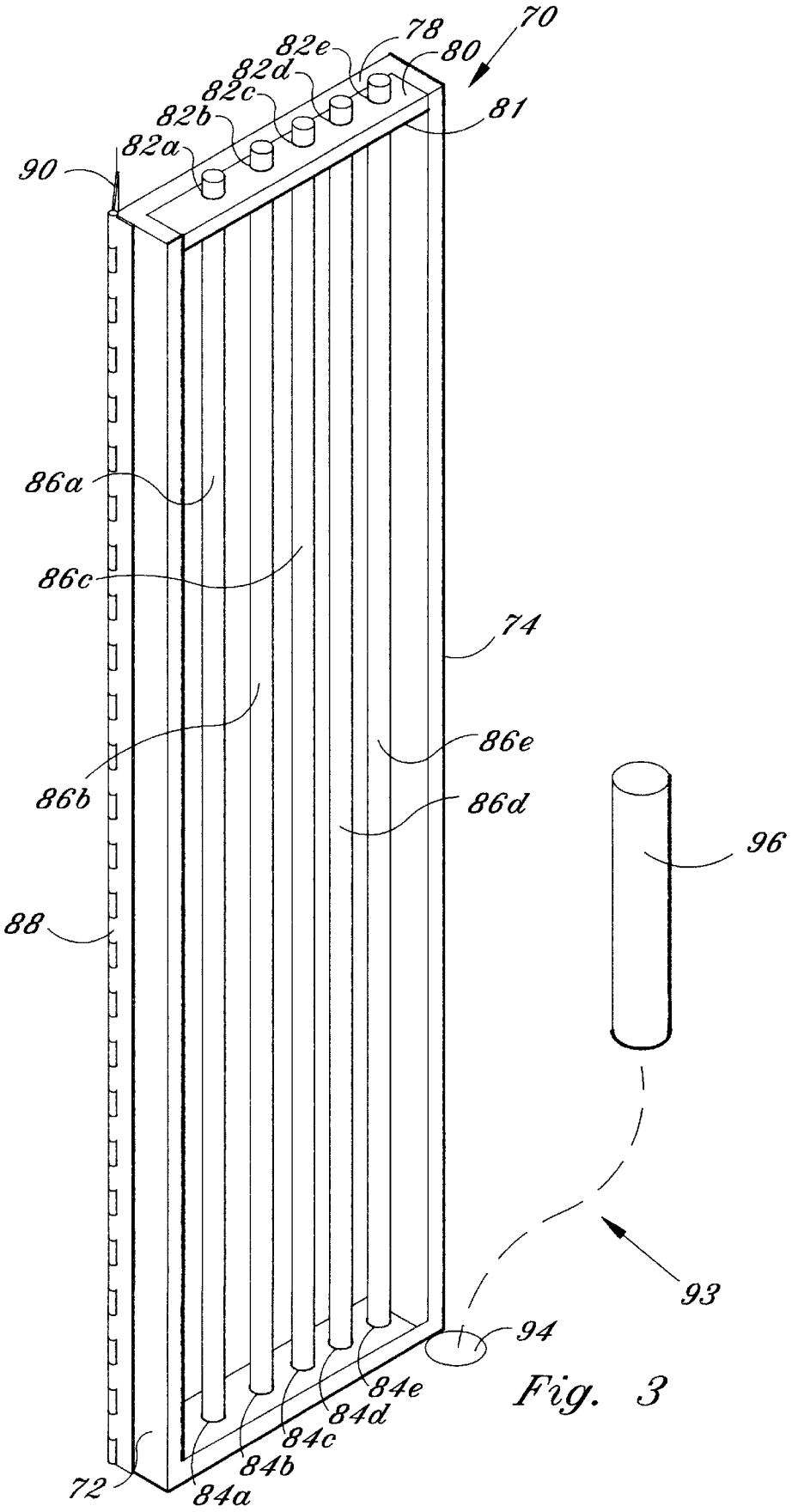
FIG. 3 is a perspective view of the photographic storage member of the first embodiment of the present invention.

Referring now to the drawings, and in particular to FIGS. 1 through 3, a first storage embodiment of the hidden photograph storage device is generally shown at reference numeral 10. Storage device generally includes a body or frame member 12 having a top wall 14, a bottom wall 16, a first side wall 18, a second side wall 20 and a rear or back wall 22. Walls 14 through 22 define a photographic storage device area 32. Top wall 14 includes an outer surface area 24 and an inner surface area 26, while bottom wall 16 includes an outer surface area 28 and an inner surface area 30. The wall portions 14 through 22 can be made out of any suitable material such as wood, plastic, or metal. Preferably, the wall portions are constructed from wood. Body 12 can be provided in a variety of shapes, all of which are considered within the scope of the invention. The shape chosen for body member 12 will determine how many wall portions are necessary.

Top wall portion 14 and bottom wall portion 16 are attached to side wall portions 18 and 20 by conventional means, such as brackets, nails, screws, glue, etc. Rear wall portion 20 is attached to wall portions 16, 18, 12, and 14 by similar conventional means. Back portion 22 provides for attachment of the invention to a wall surface of a home, or other desired location, by conventional means well known in the art.

A cover member 50 having a first end 56 and a second end 58, also preferably constructed from wood, is also provided. First end 56 of cover member 50 is preferably pivotally attached at 54 to side wall 18 by conventional means such as a hinge. When cover member 50 is in a closed or storage position, second end 58 mates with or is removably attached to side wall 20 by conventional means, such as magnets, clips, hook and loop fasteners, snaps, etc. In additionally, in lieu of an attachment means, in the closed position, second end 58 can merely rest or abut side wall 20.

The hinged member, though preferably provided along a side wall, is not limited to such and can be disposed along any portion of body 12, which will also change the location of the attachment means accordingly.

Cover 50, in one embodiment receives a mirror member 52, by conventional means, such that when second 58 is mating with side wall 20, area 32 is hidden, and it appears that a conventional mirror is disposed upon a wall to a viewer. In lieu of mirror 52, a conventional painting or photograph could also be received within cover member by conventional means to give the appearance to a viewer that an ordinary painting or photograph is disposed upon the wall. When disposing a painting or photograph in cover member 52, a sheet of glass can be provided to protect the painting or photograph.

Preferably, a plurality of photographic sheets or panels 42*a* through 42*e*, are disposed within storage area 32. Each panel contains a plurality of photograph sleeves 44*a* through 44*z*, 46*a* through 46*z*, and 48*a* through 48*z*, in which at least one photograph (not shown), is inserted into each sleeve. Any combination of photograph sleeves can be provided for each panel, including sleeves of various sizes, to accommodate various sized pictures or photographs. Each panel 42*a*–42*e*, also contains a rod receiving channel 43*a*–43*e*, respectively, for properly disposing each panel properly within storage area 32, in conjunction with an associated rod member, discussed below.

As seen in FIG. 3, a panel attachment member 70 is provided which is normally disposed within storage area 32. Panel attachment member 70 includes a first side wall 72, second side wall 74, bottom wall 76, a top wall 78 and a plurality of rod members 86*a*–86*e*. A back wall can also be provided for attachment member 70. Each rod member 86*a*–86*e* is associated with a respective photograph panel 42*a*–42*e*. Rod members 86 are preferably constructed from metal, however, such is not limiting and other materials are considered within the scope of the invention.

Top wall 78 is provided with a plurality of apertures 82*a*–82*e*. Bottom wall 76 is provided with a plurality of recesses 84*a*–84*e*. The number of apertures 82 and recesses 84 correspond to the number of rod members 86 provided, which in turn corresponds to the number of photographic panels 42 provided. The diameter size of apertures 82 and recesses 84 are slightly larger than the diameter size of rod members 86, to allow apertures 82 and recesses 84 to receive respective portions of rod members 86.

Attachment member 70 is pivotally attached to body member 12 by conventional means, such as a piano hinge 88. A first flange member 90 of hinge 88 is attached to side wall 18 of body member 12 and a second flange member 92 is attached to side wall 72 of attachment member 70. Though not preferred, attachment member 70 can permanently remain within storage area 32 and constructed not to pivot.

In one attachment embodiment, top wall 78 is permanently attached to side walls 72 and 74. In this embodiment, apertures 82*a*–82*e* extend through top wall 78 from a top surface 80 to a bottom surface 81 of top wall 78. To attach photographic panels 42*a*–42*e* in place within storage area 32, attachment member 70 is pivotally moved out from within storage area 32 and rod receiving channels (not shown), are aligned with apertures 82*a*–82*e* and recesses 84*a*–84*e* between top wall 78 and bottom wall 76, and the first ends of rod members 86*a*–86*e* are inserted through apertures 82, receiving channels and within recesses 84. Once inserted, a portion of the opposite end of rod members 86 extends out of top wall 78 to allow the rods to be withdrawn for removal of the photographic panels. Once the panels are properly attached, attachment member 70 is pivoted back within storage area 32 for storage purposes. As such, when changing, inserting and/or removing pictures from the panels, the desired panel(s) can be easily removed and placed on a table or other convenient place, thus, reducing the energy and time required for such purposes.

In another attachment embodiment, top wall 78 is removably attached to side walls 72 and 74. In this embodiment, a ledge member can be provided on the inner surfaces of at least one of the side walls 72 and 74, and preferably on both, in which top wall 78 rests upon. Bottom wall 76 and top wall 78 are provided with a plurality of recesses, similar to recesses 84, described above. To attach photographic panels 42*a*–42*e* in place within storage area 32, attachment member 70 is pivotally moved out from within storage area 32. Rod members 86 are inserted within their respective rod receiving channels 43. The first end of rod members 86, with the attached photograph panel, is inserted within its respective recess 84 of bottom wall 76. Each recess 84 of bottom wall 76 can be sufficient in depth to maintain rod member 86, with attached panel 42, in place before top wall 78 is attached, while the user is inserting the remaining rod members and attached panels. Once all of panels 42 are properly disposed, the opposite ends of rod members 86 are inserted within the recesses of top wall 78. In lieu of the recesses, top wall 78 can be provided with apertures, similar to apertures 82, in such case, the second end of rod members 86 are inserted within the apertures, and top wall 78 will rest upon the ledge members provided on the inner surfaces of side walls 72 and 74. To remove a panel(s) 42, top wall 78 is removed, and rod member 86 with the desired panel attached is simply withdrawn from the recess in bottom wall 76. Though, not preferred, if a portion of rod members 86 extends out of top wall 78, in this embodiment, the rods can be withdrawn for removal of the photographic panels, as described above in the other embodiment. Once the panels are properly attached, attachment member 70 is pivoted back within storage area 32 for storage purposes. As such, when changing, inserting and/or removing pictures from the panels, the individual can remove the desired panel(s), with its respective rod member and place such on a table or other convenient place, thus, reducing the energy and time required for such purposes.

In either attachment embodiment, top wall 78 and bottom wall 76 also act as spacing means, to provide sufficient space between panels 42, especially in view of the layers of inserted photographs which may be protruding therefrom. Each panel 42 is permitted to pivot about its associated rod member 86, thus allowing the user to view a photograph stored by one of the panels while attachment member 70 is disposed within storage area 32. Furthermore, as the photograph panels 42 can be removed, one is not solely limited to viewing the pictures at the storage device 10. Thus, an individual can easily remove a desired panel(s) and look at the photographs stored therein, anywhere, such as one would look at photographs in a photograph album.

As seen in FIG. 3, to help retain attachment member 70 within storage area 32, a stop means, generally designated at 93 can be provided. Stop means 93 can include a recess 94 disposed within inner surface 30 of bottom wall 16 and a peg member 96. Recess 94 is positioned just ahead of attachment member 70, when attachment member 70 is properly positioned within storage area 32. Once properly positioned, a portion of peg member 96 is inserted within recess 94 to prevent attachment member 70 from inadvertently pivoting out of its desired position. However, when it is desirable to pivot attachment member 70 from within storage area 32, peg member 96 is simply removed by the user, thus, allowing attachment member 70 to freely pivot, as described above.

Though the peg/recess combination is the preferred embodiment for stop means 93, other conventional embodiments are within the scope of the present invention. Such alternative embodiments could include a small ledge protruding from the inner surface 30 of bottom wall 16.

Sufficient force would be required to be exerted on attachment member 70, to allows such to overcome the barricade provided by the ledge. Thus, attachment member could not inadvertently pivot, as such would not provide the force required to overcome the ledge member.

Particularly where attachment member 70 does not pivot, top wall 78 and bottom wall 76 can be positioned within storage area 32 at an angle in relation to the side wall of frame member 12 to provide easy display of the photographs which are inserted within the photographic panels 42. Frame member 12, as well as photograph panels 42 can be of any dimensions, and should be relatively large in order to hold hundreds, if not thousands, of photographs which may have accumulated over time.

The hinged member, cover attachment member or other pivot means, are all preferably concealed from view, when the cover member is in its closed position.

Each panel is preferably constructed from wood, though other materials may be utilized and are considered within the scope of the invention. Each panel is preferably provided with a certain amount of thickness to insure that each panel is rigid, and not relatively flimsy.

Figure 4:
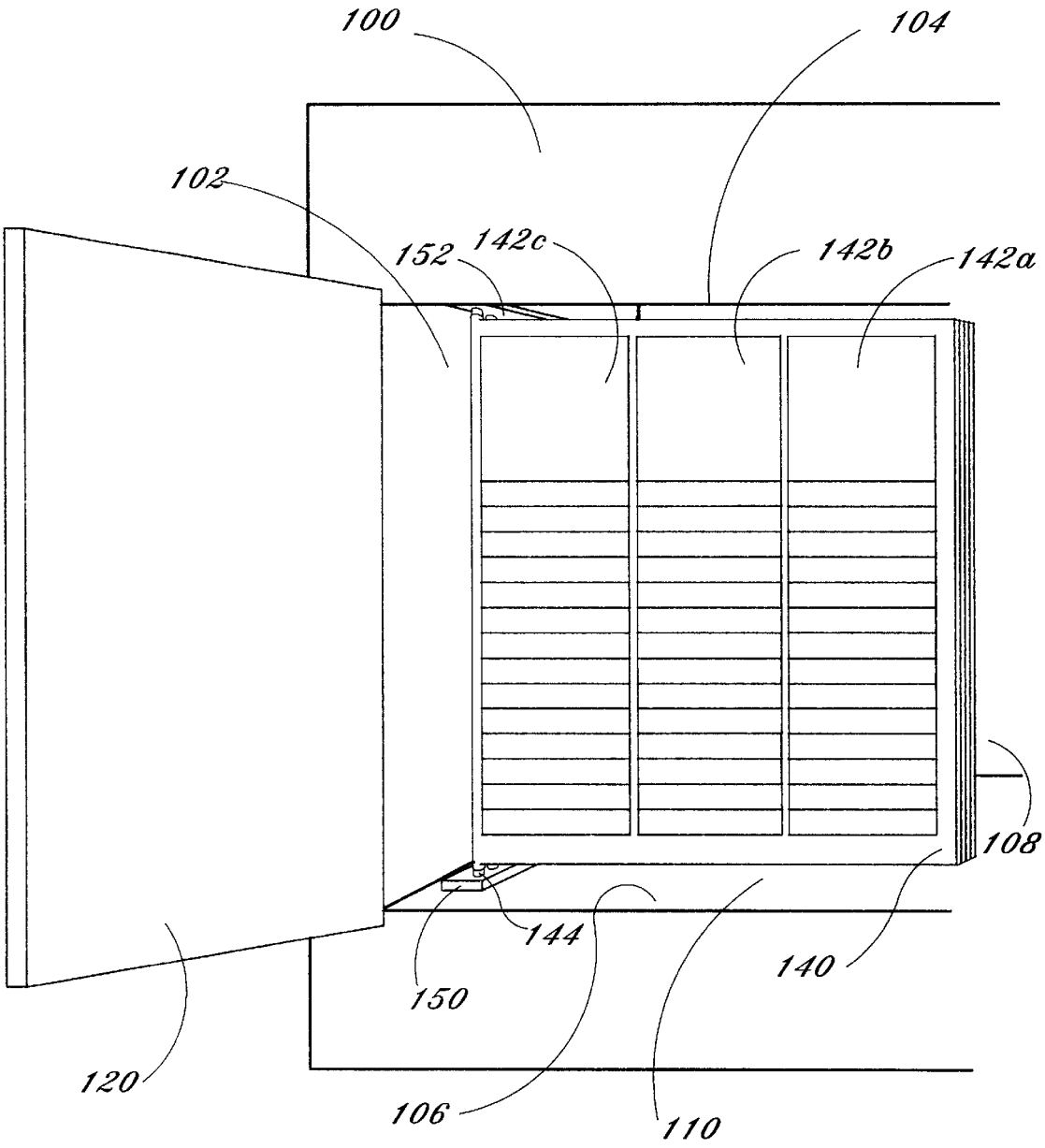
FIG. 4 is a front elevational view of a second embodiment of the present invention.

An alternative storage embodiment of the present invention is shown in FIG. 4. In this embodiment the photographic storage device is shown disposed within a compartment 110 of a conventional wall unit 100. Furthermore, the present invention can be utilized with a compartment of any conventional furniture, and such is within the scope of the invention. A door 120 is attached to compartment 110 by conventional means such as a hinge. Door 120 is a conventional door normally associated with a wall unit or piece of furniture. Compartment 110 is defined by a first side wall 102, top wall 104, bottom wall 106, back wall 108 and second side wall (not shown but similar to side wall 102). A plurality of photographic panels 140 are stored within compartment 110 and are out of sight when door 120 is closed. Thus, when door 120 is in its closed position, the photographic storage device is out of sight, and a conventional wall unit or other piece of furniture is seen.

Panels 140 are similar to photographic panels 42 of the first embodiment, and each similarly contain a plurality of insert sleeves 142. Panels 140 are attached to compartment 110 via rod member 144 and top and bottom rod supports 152 and 154, respectively. Each panel 140 has a respective rod member 144, with a first end of the rod member disposed within a respective recess in top rod support 152 and a second end of the rod member disposed within a respective recess in bottom rod support 150. Similar to the first embodiment, each panel 140 has a rod receiving channel for receiving its respective rod member 144, prior to the insertion of the ends of rod member 144 into the recesses of top and bottom rod supports 152 and 154, respectively. The support recesses and rod members 144 are similar to the recesses and rod members 86 of the first embodiment.

Each panel 140 is allowed to pivot around the axis define by its respective rod member 144, similar to the first embodiment. Thus, the user can view through a plurality of photographs located in the front of compartment 110, while utilized the back of compartment 110 for storage purposes. Top rod support 152 and bottom rod support can be permanently attached by conventional means to top wall 104 and bottom wall 106, respectively, such as by nails, screws, glues, etc. Alternatively, supports 152 and can be removably attached to walls 104 and 106, respectively, also by conventional means such as hook and loop fasteners, pin and slot combinations, etc.

In lieu of supports 152 and an attachment member and stop means (not shown) similar to the various attachment members 70 and stop means 93 of the first embodiment can be utilized to allow panels 140 to pivot out of compartment 110 and be easily removed as described above. Thus, the advantages described above for the first storage embodiment are also present with the alternative storage embodiment.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A hidden photographic storage and display device comprising:

a plurality of photographic storage panels, each of said panels having a plurality of photographic insert sleeve members disposed thereon, each of said photographic sleeve members capable of storing at least one photograph;

means for housing said photographic storage panels, said means for housing including a cover member, said means for housing concealing said plurality of photographic storage panels and any photographs disposed within an associated photographic insert sleeve member when said cover member is in a closed position, said means for housing attached to an outer surface of a wall member;

said cover member having an outer appearance of a decorative element:

wherein said device providing an outer appearance of a decorative element as well as providing a hidden storage area for the plurality of photographs when said cover member is in a closed position.

2. The hidden photographic storage and display device of claim 1 wherein said means for housing is a frame member having a top wall, bottom wall, first side wall and second side wall.

3. The hidden photographic storage and display device of claim 1 further including means for pivoting said plurality of photographic panels out of said means for housing.

4. The hidden photographic storage and display device of claim 3 further including means for preventing said means for pivoting from moving.

5. The hidden photographic storage and display device of claim 1 wherein said decorative element is a mirror, painting, photographic or other conventional artwork or design.

6. The hidden photographic storage and display device of claim 5 wherein said means for pivoting comprises:

an attachment member pivotally associated with said means for housing; and a plurality of rod members, each of said plurality of rod members associated with a respective one of said plurality of photographic panels, said plurality of rod members removably attached to said attachment member;

wherein said attachment member can be pivoted out of said housing means causing said panels to be pivoted out of said housing means for ease of removing or viewing photographs stored by said panels.

7. The hidden photographic storage and display device of claim 6 wherein each of said plurality of panels can pivot around its associated rod member when said rod member is attached to said attachment member.

8. A hidden photographic storage and display device comprising:

a plurality of photographic storage panels, each of said panels having a plurality of photographic insert sleeve members disposed thereon, each of said photographic sleeve members capable of storing at least one photograph;

means for housing said photographic storage panels, said means for housing including a cover member, said means for housing concealing said plurality of photographic storage panels and any photographs disposed within an associated photographic insert sleeve member when said cover member is in a closed position;

said cover member having an outer appearance of a decorative element;

wherein said device providing an outer appearance of a decorative element as well as providing a hidden storage area for the plurality of photographs when said cover member is in a closed position;

means for pivoting said plurality of photographic panels out of said means for housing; and means for preventing said means for pivoting from moving;

wherein said means for preventing comprises a recess disposed within said means for housing and a peg member, a portion of said peg member disposed within said recess to prevent said means for pivoting from moving, said peg member being removed when it is desired to move said means for pivoting.

9. A hidden photographic storage and display device, said device allowing a user to readily and easily view a plurality of stored photographs, said device having an outer appearance to conceal the plurality of stored photographs, said device comprising:

a plurality of photographic storage panels, each of said panels having a plurality of photographic insert sleeve members disposed thereon, each of said photographic sleeve members capable of storing at least one photograph;

a frame member having a top wall, bottom wall, first side wall and second side wall, said walls defining a storage area;

a cover member attached to said frame member said photographic storage panels housed within said storage area along with any photographs disposed within associated photographic insert sleeve members when said cover member is in a closed position;

said plurality of photographic storage panels concealed within said storage area when said cover member is in a closed position;

an attachment member pivotally associated with said frame member; and a plurality of rod members, each of said plurality of rod members associated with a respective one of said plurality of photographic panels, said plurality of rod members removably attached to said attachment member;

wherein said attachment member can be pivoted out of said frame member causing said panels to be pivoted out of said frame member for ease of removing or viewing photographs stored within one or more of said photographic insert sleeve members;

wherein said device hiding said storage area when said cover member is in a closed position;

wherein said bottom wall having a recess disposed therein and said device further including a peg member, a portion of said peg member disposed within said recess to prevent said attachment member from moving, said peg member being removed when it is desired to move said attachment member.

10. The hidden photographic storage and display device of claim 9 wherein said frame member is located within a piece of furniture.

11. The hidden photographic storage and display device of claim 9, wherein said frame member is adapted to be attached to an outer surface of a wall member.

12. The hidden photographic storage and display device of claim 9 wherein each of said photographic panels sufficiently spaced from adjacent photographic panels when disposed within said means for housing to allow one or more of said photographic panels to be provided with layers of photographs.

13. The hidden photographic storage and display device of claim 9 wherein each photographic panel can be removed from its attachment to said frame member without having to remove the remaining photographic panels.

14. The hidden photographic storage and display device of claim 9 wherein said cover member having an outer appearance of a decorative element, wherein said decorative element can either be a painting, photograph, mirror, or other conventional artwork or design, wherein said device having an outer appearance of a decorative element as well as hiding said storage area when said cover member is in a closed position.

15. The hidden photographic storage and display device of claim 9 wherein each of said plurality of panels can pivot around its associated rod member when said rod member is attached to said attachment member.

16. A hidden photographic storage and display device, said device allowing a user to readily and easily view a plurality of stored photographs, said device having an outer decorative appearance to conceal the plurality of stored photographs, said device comprising:

a plurality of photographic storage panels, each of said panels having a plurality of photographic insert sleeve members disposed thereon, each of said photographic sleeve members capable of storing at least one photograph, each of said photographic panels sufficiently spaced from adjacent photographic panels to allow one or more of said photographic panels to be provided with layers of photographic insert sleeve members;

a frame member having a top wall, bottom wall, first side wall and second side wall, said walls defining a storage area;

a cover member attached to said frame member, said photographic storage panels housed within said storage area along with any photographs disposed within associated photographic insert sleeve members when said cover member is in a closed position;

said plurality of photographic storage panels concealed within said storage area when said cover member is in a closed position, said cover member having an outer appearance of an embossed decorative element;

an attachment member pivotally associated with said frame member; and a plurality of rod members, each of said plurality of rod members associated with a respective one of said plurality of photographic panels, said plurality of rod members removably attached to said attachment member, each of said plurality of panels capable of pivoting around its associated rod member, each of said photographic panels capable of being removed from its attachment to said frame member without having to remove any remaining photographic panels;

wherein said attachment member can be pivoted out of said frame member causing said panels to be pivoted out of said frame member for ease of removing or viewing photographs stored within one or more of said photographic insert sleeve members, said bottom wall having a recess disposed therein and said device further including a peg member, a portion of said peg member disposed within said recess to prevent said attachment member from pivoting, said peg member being removed when it is desired to pivot said attachment member;

wherein said device having an outer appearance of an embossed decorative element as well as hiding said storage area when said cover member is in a closed position.

17. A hidden photographic storage and display device comprising:

a plurality of photographic storage panels, each of said panels having a plurality of photographic insert sleeve members disposed thereon, each of said photographic sleeve members capable of storing at least one photograph;

means for housing said photographic storage panels, said means for housing including a cover member, said means for housing concealing said plurality of photographic storage panels and any photographs disposed within an associated photographic insert sleeve member when said cover member is in a closed position;

wherein said device providing a hidden storage area for the plurality of photographs when said cover member is in a closed position;

means for pivoting said plurality of photographic panels out of said means for housing; and means for preventing said means for pivoting from moving;

wherein said means for preventing comprises a recess disposed within said means for housing and a peg member, a portion of said peg member disposed within said recess to prevent said means for pivoting from moving, said peg member being removed when it is desired to move said means for pivoting.

18. The hidden photographic storage and display device of claim 17 wherein said means for housing is adapted to be attached to an outer surface of a wall member.

19. The hidden photographic storage and display device of claim 17 wherein said means for housing is located within a piece of furniture.

* * * * *